US007699149B2

(12) United States Patent
Lin et al.

(10) Patent No.: US 7,699,149 B2
(45) Date of Patent: Apr. 20, 2010

(54) ZIPPERLESS EXPANSION SYSTEM

(76) Inventors: Shin-Fu Eiken Lin, 4F-3, No. 51, Section 2, Kaclung Road., Taipei (TW); Shou Mao Alberto Chen, 344 Section 1, Chung Shen Rd., Taichia, Taichung (TW)

( * ) Notice: Subject to any disclaimer, the term of this patent is extended or adjusted under 35 U.S.C. 154(b) by 1064 days.

(21) Appl. No.: 11/324,101

(22) Filed: Dec. 30, 2005

(65) Prior Publication Data

US 2007/0151820 A1 Jul. 5, 2007

(51) Int. Cl.
*A45C 7/00* (2006.01)

(52) U.S. Cl. ..... 190/103

(58) Field of Classification Search ..... 190/103–105; 220/9.2

See application file for complete search history.

(56) References Cited

U.S. PATENT DOCUMENTS

| | | | | | |
|---|---|---|---|---|---|
| 440,278 | A | | 11/1890 | Payntar | |
| 587,487 | A | | 8/1897 | Palica | |
| 701,440 | A | | 6/1902 | Wilkinson | |
| 710,037 | A | | 9/1902 | Bodwell | |
| 764,144 | A | | 7/1904 | McGowan | |
| 892,125 | A | * | 6/1908 | Bourne | 190/104 |
| 1,052,018 | A | | 2/1913 | Spitz | |
| 1,141,638 | A | * | 6/1915 | Hill | 220/9.2 |
| 1,573,721 | A | * | 2/1926 | Loeffler | 190/107 |
| 1,756,775 | A | | 4/1930 | Frankland-Winning | |
| 2,002,878 | A | * | 5/1935 | Belber | 190/103 |
| 2,042,288 | A | * | 5/1936 | Bach et al. | 383/25 |
| 2,096,768 | A | | 10/1937 | Styll | |
| 2,110,617 | A | | 3/1938 | Wolff | |
| 2,475,961 | A | | 7/1949 | Hilbert | |
| 3,152,833 | A | | 10/1964 | Criveling et al | |
| 3,321,053 | A | | 5/1967 | Doppelt | |
| 3,410,328 | A | * | 11/1968 | Sasai | 220/9.2 |
| 3,450,237 | A | | 6/1969 | Dyke | |
| 3,504,772 | A | | 4/1970 | Barry | |
| 3,587,795 | A | | 6/1971 | Barry et al. | |
| 4,128,150 | A | | 12/1978 | Popkin et al. | |
| 4,294,463 | A | | 10/1981 | Kotani | |
| 4,356,899 | A | | 11/1982 | Tawil | |
| 4,610,333 | A | | 9/1986 | Seynhaeve | |
| 4,733,759 | A | | 3/1988 | Shih-Chen | |

(Continued)

FOREIGN PATENT DOCUMENTS

EP 0189007 A1 7/1986

OTHER PUBLICATIONS

Victorinox Triax TX24 Wheeled Luggage Closeout—http://www.rei.com/online/store/ProductDisplay...09/26/2005.

(Continued)

*Primary Examiner*—Tri M Mai
(74) *Attorney, Agent, or Firm*—Orrick, Herrington & Sutcliffe LLP

(57) ABSTRACT

The present invention provides an expansion system for luggage comprising an upper frame, a lower frame, an expandable section attached between the upper and lower frames, and expansion mechanisms. Each expansion mechanism comprises an upper member attached to the upper frame, a lower member attached to the lower frame and two arms, wherein each arm is pivotally connected to the upper member at one end and is pivotally and slideably connected to the lower member at the other end.

19 Claims, 5 Drawing Sheets

U.S. PATENT DOCUMENTS

| | | | |
|---|---|---|---|
| 4,756,394 | A | 7/1988 | Cohoen |
| 4,773,515 | A | 9/1988 | Kotkins, Jr. |
| 4,787,488 | A | 11/1988 | Campanini |
| 4,813,520 | A | 3/1989 | Lin |
| 4,844,214 | A | 7/1989 | Castelli et al. |
| 4,844,215 | A | 7/1989 | Ambasz |
| 4,846,319 | A | 7/1989 | Sadow |
| 4,854,430 | A | 8/1989 | Peterson |
| 4,953,673 | A | 9/1990 | Ambasz |
| 5,080,206 | A | 1/1992 | Tawil |
| 5,082,094 | A | 1/1992 | Nechushtan |
| 5,088,396 | A | 2/1992 | Thomas |
| 5,307,908 | A | 5/1994 | Shyr et al. |
| 5,314,046 | A | 5/1994 | Pedrini |
| 5,358,082 | A | 10/1994 | Armstrong, IV |
| 5,664,652 | A | 9/1997 | Shamah |
| 5,671,831 | A | 9/1997 | Chiu |
| 5,749,446 | A | 5/1998 | Hsieh |
| 5,819,891 | A | 10/1998 | Wang et al. |
| 6,021,874 | A | 2/2000 | Nykoluk |
| 6,022,146 | A | 2/2000 | Bull |
| 6,059,078 | A | 5/2000 | Nykoluk |
| 6,220,411 | B1 | 4/2001 | Scicluna et al. |
| 6,227,397 | B1 | 5/2001 | Kim |
| 6,305,513 | B1 | 10/2001 | Lu |
| 6,378,674 | B1 | 4/2002 | Lee |
| 6,390,259 | B1 | 5/2002 | Lu |
| 6,408,997 | B1 | 6/2002 | Chen |
| 6,408,998 | B1 | 6/2002 | Saito et al. |
| 6,533,087 | B1 | 3/2003 | Chen |
| 6,575,272 | B1 | 6/2003 | Krulik et al. |
| 6,591,950 | B1 | 7/2003 | Scicluna |
| 6,609,598 | B2 | 8/2003 | Hsu |
| 2002/0040834 | A1 | 4/2002 | Chen |
| 2002/0125277 | A1 | 9/2002 | Lim et al. |
| 2002/0130004 | A1 | 9/2002 | Lin |
| 2002/0153216 | A1 | 10/2002 | Krulik |
| 2002/0185350 | A1 | 12/2002 | Chang et al. |
| 2003/0000784 | A1 | 1/2003 | Hsu |
| 2004/0035661 | A1 | 2/2004 | Krulik et al. |
| 2004/0262111 | A1 | 12/2004 | Ghiassi |
| 2005/0067244 | A1 | 3/2005 | Smith et al. |

OTHER PUBLICATIONS

"New NXpandable", www.briggs-riley.com/home.html (Aug. 15, 2002).

Delsey Horizon II 29 Expandable Suiter Trolley Luggage, http://www.jdhodges.com/bags/15947.html (Sep. 26, 2005).

* cited by examiner

ZIPPERLESS EXPANSION SYSTEM

The present invention relates to expandable luggage, and more particularly to expandable luggage having a zipperless expansion system.

BACKGROUND OF THE INVENTION

Expandable luggage are well known. Many expandable luggage use a zipper expansion system comprising two frames, an expandable section of fabric attached between the two frames, and a zipper running along the perimeter of the luggage between the two frames. In other expandable luggage, the expandable section is located at the edge of the luggage without framing, in which case the expansion is soft. The zipper is closed to decrease the volume of the luggage by pulling together the two frames or expansion fabric and folding the expandable section into the interior of the luggage. The zipper is opened to expand the volume of the luggage by allowing the two frames to move apart and the expandable section to unfold.

The zipper expansion system has several disadvantages. One disadvantage is that the zipper expansion system does not enable a person to adjust the volume of the luggage to intermediate volumes between the zipped closed and zipped open configuration. This is because all of the fabric of the expandable section is loosened when the zipper is opened. Another disadvantage is that the expandable section does not provide a semi-rigid support to protect articles inside the luggage from external forces exerted on the luggage, such as other luggage placed on top of the luggage.

Another type of expansion system comprises two frames, plates attached to the frames, and a locking mechanism. The volume of the luggage is adjusted by sliding the plates attached to one of the frames along rails on the other frame. The locking mechanism is used to lock the plates into place at a desired volume. A disadvantage of this expansion system is that strong external forces exerted on the luggage, such as shock, can break and/or damage the locking mechanism.

Therefore, there is a need for an expansion system that enables a person to adjust the volume of luggage to intermediate volumes depending on the person's travel needs, provides semi-rigid support, and is not prone to break when strong external forces are exerted on luggage.

SUMMARY OF THE INVENTION

The present invention provides a zipperless expansion system that overcomes the disadvantages of the prior art.

In one exemplary embodiment, the expansions system comprises an upper frame, a lower frame, an expandable section attached between the upper and lower frames, and expansion mechanisms. Each expansion mechanism comprises an upper member attached to the upper frame, a lower member attached to the lower frame and two arms, wherein each arm is pivotally connected to the upper member at one end and is pivotally and slideably connected to the lower member at the other end. The expansion mechanism further comprises springs for urging the two arms to opposite ends of the lower member and an adjustable fastener for adjustably fastening the upper member to the lower member.

In an expanded configuration, the adjustable fastener is loosened allowing the urging force of the springs to move the arms to opposite ends of the lower member. This action causes the upper and lower members to move apart, thereby expanding the volume of the luggage. In a compressed configuration, the adjustable fastener is tightened to move the upper and lower members closer together against the urging force of the springs, thereby decreasing the volume of the luggage.

One advantage of the expansion system of the present invention is that it enables a traveler to adjust the volume of luggage between the expanded and compressed configurations by using the adjustable fastener to adjust the distance between the upper and lower member. Another advantage is that the expansion system of the present invention provides semi-rigid support for luggage compared to prior art systems that use only an expandable section made of fabric. This is because, after the expansion system has been adjusted to a desired luggage volume, the fastener resists further expansion of the expansion mechanism and the urging force of the springs resists further compression of the expansion mechanism. Another advantage is that the expansion mechanism does not easily break from external forces exerted on the luggage. This is because the expansion mechanism resiliently responds to strong external downward forces by compressing instead of breaking.

Other systems, methods, features and advantages of the invention will be or will become apparent to one with skill in the art upon examination of the following figures and detailed description.

DETAILED DESCRIPTION

Figure 1:
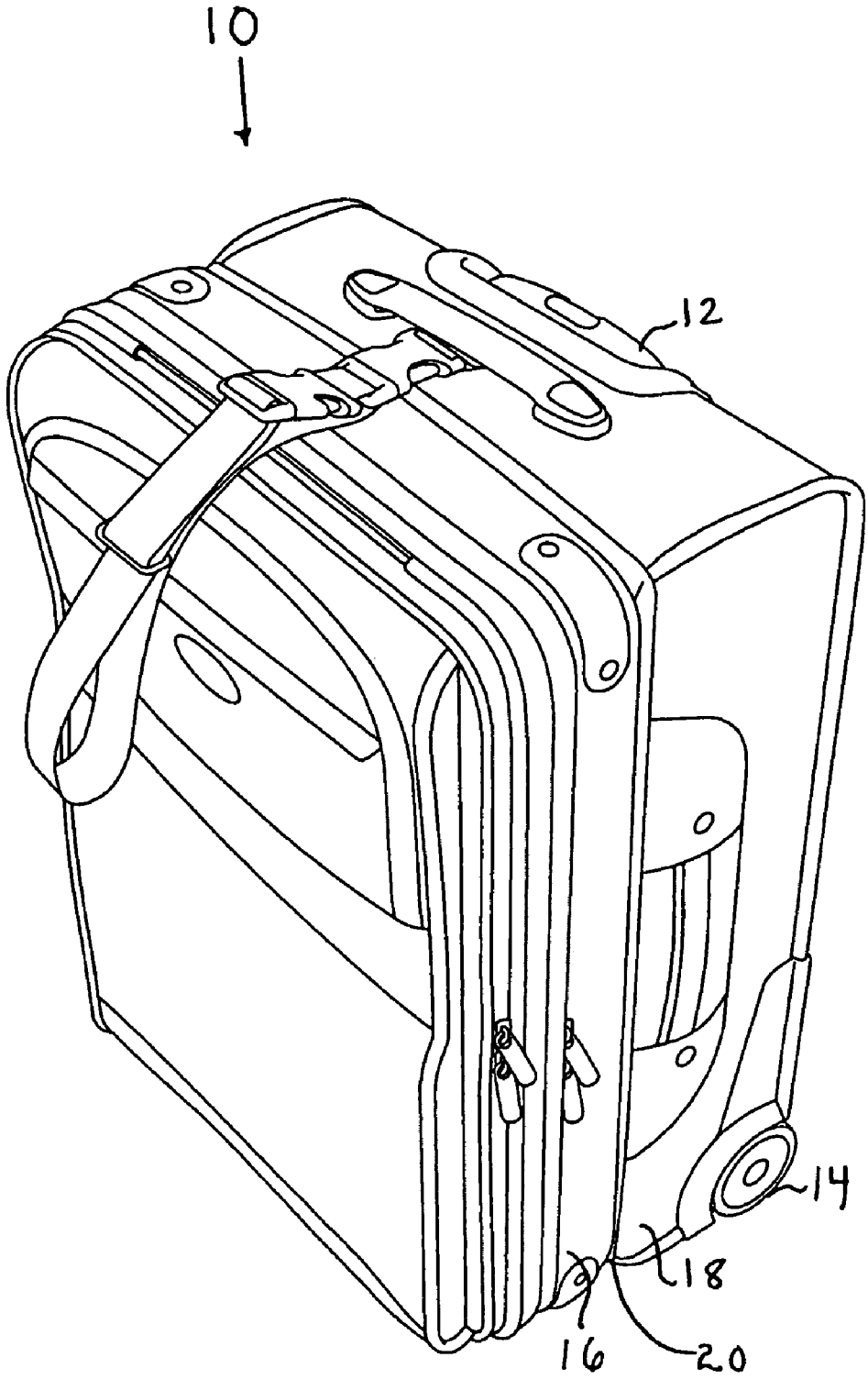
FIG. 1 is a perspective view of an exemplary expandable suitcase in a compressed configuration.
Figure 2:
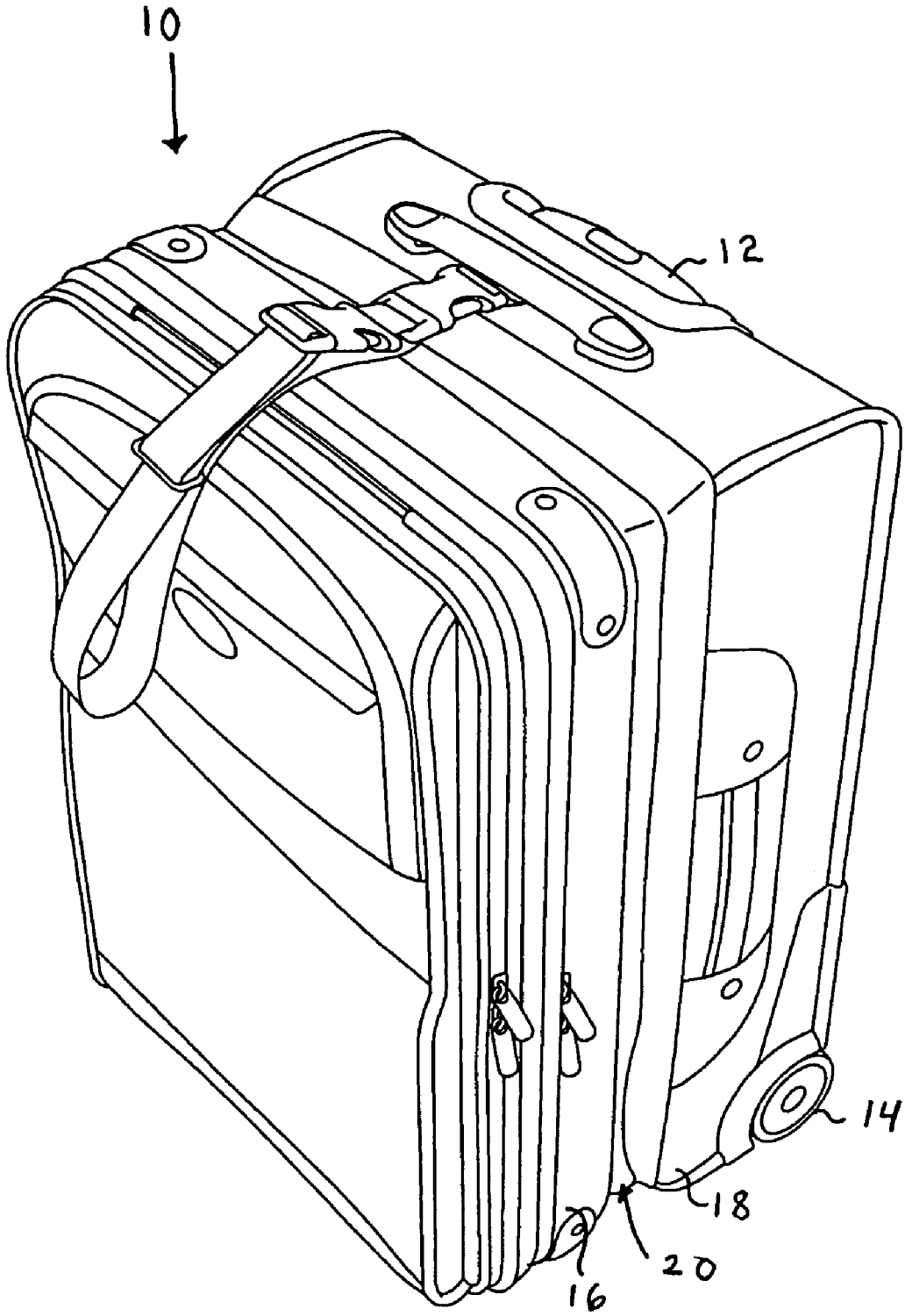
FIG. 2 is a perspective view of the exemplary expandable suitcase in an expanded configuration.

Turning now to the drawings, FIGS. 1 and 2 show an exemplary suitcase 10 in which the expansion system of the invention may be used. The exemplary suitcase 10 is a trolley-type suitcase having a telescoping handle 12 and two wheels 14 for rolling the suitcase 10 on the ground. The suitcase 10 also has a pocket 13 and different compartments for segregating articles in the suitcase 10. Zippers 11 open to a main interior compartment of the suitcase 10 and zippers 9 open to a smaller front compartment. The expansion system of the invention is not limited to the suitcase 10 shown in FIGS. 1 and 2 and may be used in other types of luggage including briefcases, computer cases, carry-on luggage, backpacks, and the like.

Figure 3:
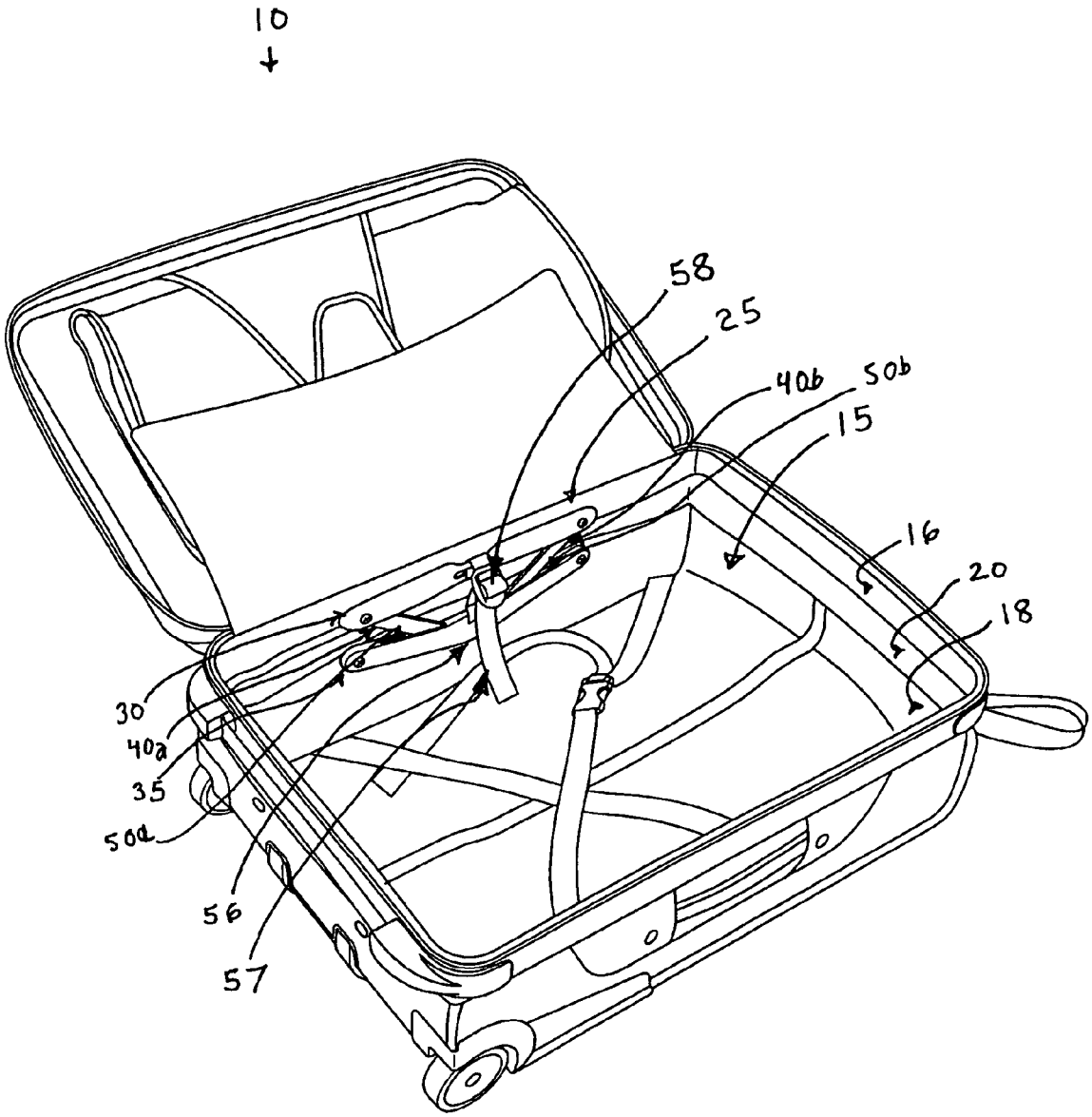
FIG. 3 is a perspective view of the suitcase opened to reveal an expansion system according to an embodiment in the compressed configuration.
Figure 4:
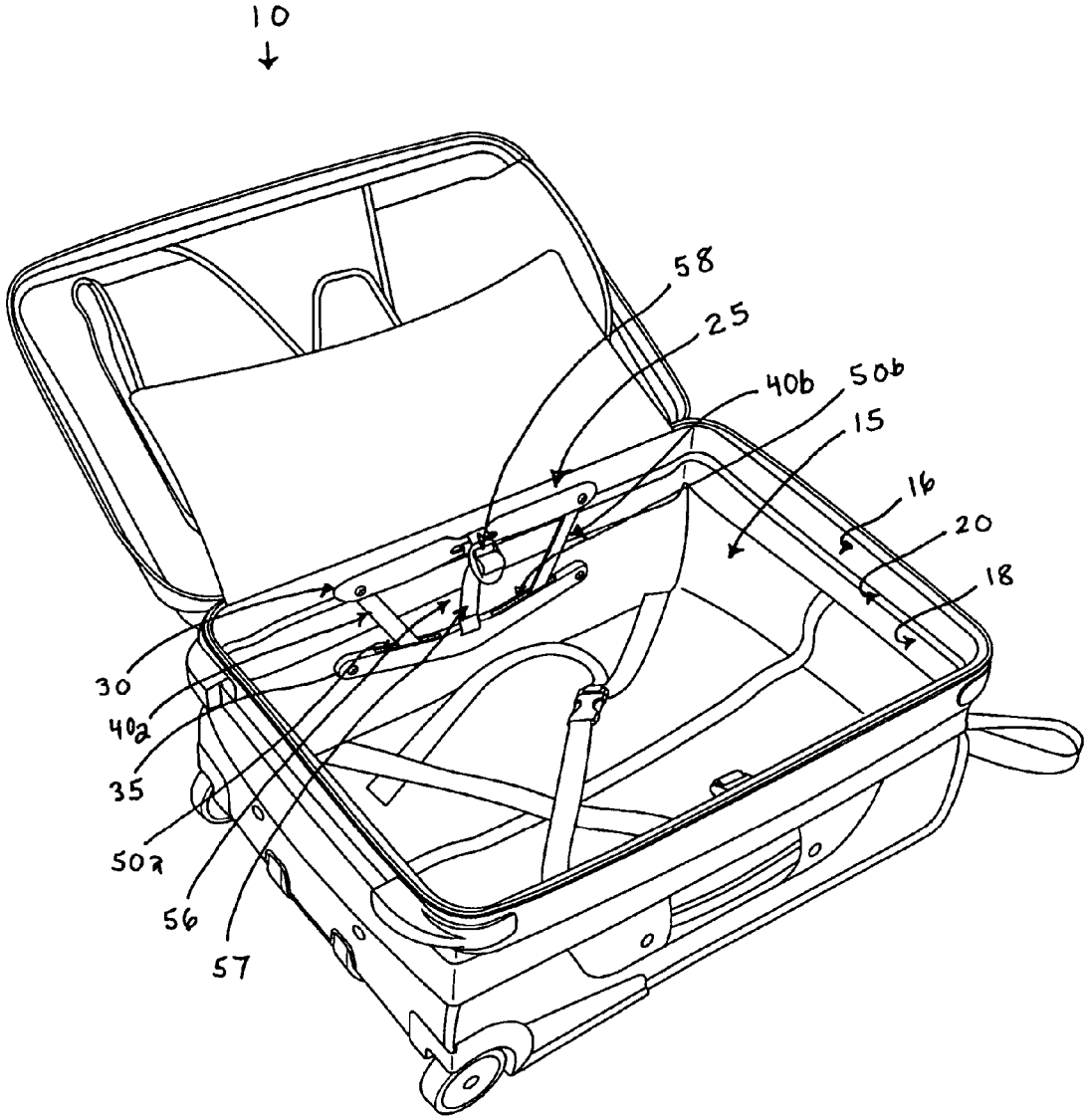
FIG. 4 is a perspective view of the suitcase opened to reveal the expansion system in the expanded configuration.

FIGS. 3 and 4 show the exemplary suitcase 10 with the main interior compartment 15 of the suitcase 10 open. The suitcase 10 comprises an upper frame 16 and a lower frame 18 that run along the perimeter of the suitcase 10. Each of the frames 16 and 18 in FIGS. 3 and 4 has a rectangular shape, although others shapes may be used depending on the shape of the suitcase. Preferably the frames 16 and 18 are made of a light weight and rigid construction known in the art. The upper frame 16 and the lower frame 18 are attached to each other by an expandable section 20 that runs along the perimeter of the suitcase. The expandable section 20 may be made of fabric, ballistic nylon, leather or the like. The expandable section 20 allows expansion of the suitcase 10 from a compressed configuration to an expanded configuration.

FIG. 1 shows the suitcase 10 in the compressed configuration, in which the expandable section 20 is folded into the interior of the suitcase 10. FIG. 2 shows the suitcase 10 in the expanded configuration, in which the expandable section 20 is pulled taunt increasing the volume of the suitcase 10.

Turning back to FIGS. 3 and 4, the expansion system of the invention includes two expansion mechanisms 25 in the interior compartment 15 of the suitcase 10. The expansion mechanisms 25 are attached to opposite sides of the interior compartment 15. Although FIGS. 3 and 4 only show one of the expansion mechanisms 25, it is to be understood that the other expansion member is attached to the opposite side of the interior compartment 15. Although two expansion mechanisms 25 are used in the preferred embodiment, any number of two or more expansion mechanisms may be used.

Each expansion mechanism 25 includes an upper member 30 attached to the interior wall of the upper frame 16 and a lower member 35 attached to the interior wall of the lower frame 18. The members 30 and 35 may be attached to their respective frames 16 and 18 by screws, rivets, bolts or the like. The upper member 30 and the lower member 35 are connected to each other by two arms 40*a* and 40*b*. The top ends of the arms 40*a* and 40*b* are pivotally connected to opposite ends of the upper member 30. The bottom ends of the arms 40*a* and 40*b* are pivotally and slideably connected to the lower member 35. The members 30 and 35 and arms 40*a* and 40*b* may be made of plastic, metal, composite material or other rigid material.

Figure 5:
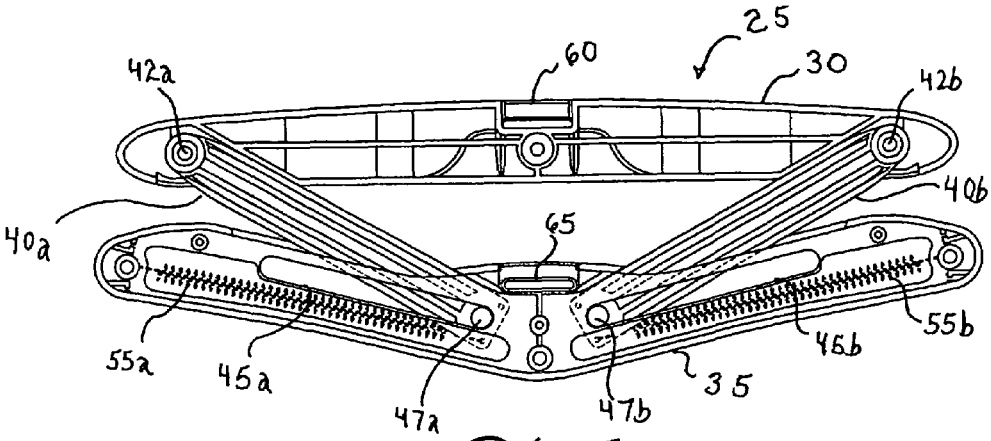
FIG. 5 is a back view of an expansion mechanism according to an embodiment in the compressed configuration.
Figure 6:
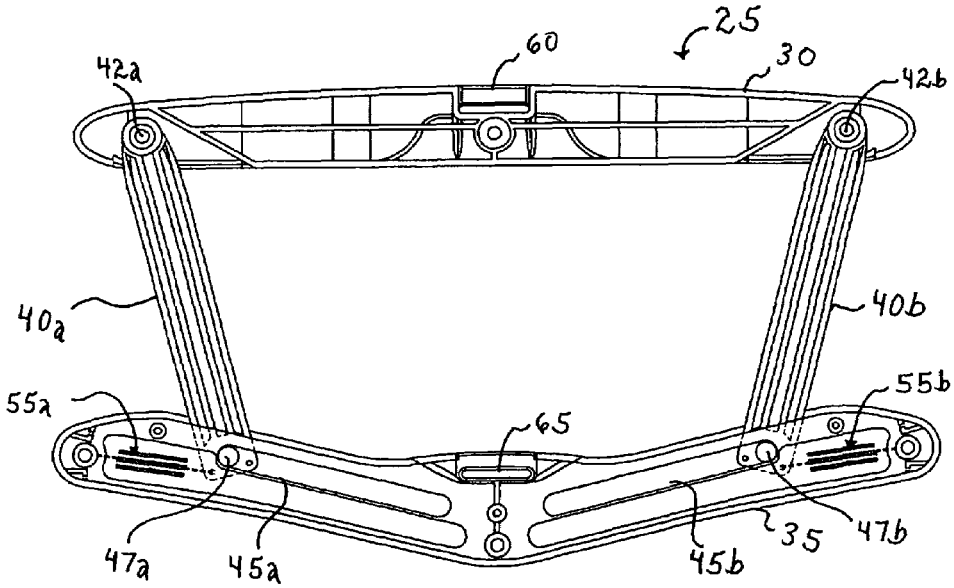
FIG. 6 is a back view of the expansion mechanism in the expanded configuration.

FIGS. 5 and 6 show a back view of one of the expansion mechanisms 25. Each arm 40*a* and 40*b* has a hole 42*a* and 42*a* through which a screw pivotally connects the arm to the upper member 30. The screw may be the same screw attaching the upper member 30 to the upper frame 16.

The lower member 35 has two elongated slots 45*a* and 45*b*. Each arm 40*a* and 40*b* has a circular pin 47*a* and 47*b* that is slideably received in the respective slot 45*a* and 45*b*. The circular pin 47*a* and 47*b* allows the arm 40*a* and 40*b* to both pivot and slide within the respective slot 45*a* and 45*b*. Alternatively or in addition, a pin having the same or different shape may be pivotally connected to the arm 40*a* and 40*b* to allow the arm 40*a* and 40*b* to pivot with respect to the lower member 35. The lower member 35 also has guiding slots 50*a* and 50*b* through which each arm 40*a* and 40*b* is inserted into the lower member 35 (see FIGS. 3 and 4). The guiding slots 50*a* and 50*b* help guide the sliding movements of the arms 40*a* and 40*b*.

Each expansion member 25 further comprises two springs 55*a* and 55*b*. Each spring 55*a* and 55*b* is connected at one end to one of the arms 40*a* and 40*b* and at the other end to the lower member 35. The springs 55*a* and 55*b* are connected to opposite ends of the lower member 35. This causes the springs 55*a* and 55*b* to urge or bias the arms 40*a* and 40*b* towards opposite ends of the lower member 35, as shown in FIG. 6.

When a downward force is applied to the upper member 30, the arms 40*a* and 40*b* move toward the center of the lower member 35 and the springs 55*a* and 55*b* are stretched, as shown in FIG. 5. To facilitate movement of the arms 40*a* and 40*b* toward the center of the lower member 35, the slots 45*a* and 45*b* slope slightly downward towards the center. The stretching of the springs 55*a* and 55*b* produces an urging force that urges the arms 40*a* and 40*b* back to the opposite ends of the lower member 35 when the downward force is removed. Although coil springs are shown, other types of springs may be used to urge or bias the arms. Alternatively or in addition, an elastic material, e.g., bungee cords and/or rubber bands, may be used to urge or bias the arms.

The upper member 30 and the lower member 35 move relative to each other based on the positions of the arms 40*a* and 40*b* on the lower member 35. When little or no downward force is applied to the upper member 30, the springs 55*a* and 55*b* pull the arms 40*a* and 40*b* to opposite ends of the lower member 35. In this configuration, the separation between the upper member 30 and the lower member 35 is maximum and the expansion mechanism 25 expands the volume of the suitcase 10. When a downward force is applied to the upper member 30, the downward force pushes the arms 40*a* and 40*b* toward the center of the lower member 30 against the urging force of the springs 55*a* and 55*b*. This causes the upper member 30 and the lower member 35 to move closer together and the expansion mechanism 25 to compress, thereby decreasing the volume of the suitcase 10. When the downward force is released, the springs 55*a* and 55*b* pull the arms 40*a* and 40*b* back to the expanded configuration.

Returning to FIGS. 3 and 4, each expansion mechanism includes an adjustable strap 56 attached to the upper member 30 and the lower member 35. The adjustable strap 56 includes a strip or band 57 formed into a loop that passes through slots 60 and 65 in the upper member 30 and the lower member 35 (shown in FIGS. 5 and 6). The strip 57 may be made of nylon. The adjustable strap 56 further includes a buckle 58 for adjusting the length of the strap loop. One end of the strip 57 is connected to the buckle 58 and the other end is threaded through the buckle 58. Other types of buckles may be used beside the one shown in the FIGS. 3 and 4, such as a quick release buckle. Further, the buckle may be molded into the upper or lower member instead of being a separate component. Also, other types of adjustable fasteners may be used to adjustably fasten the upper member to the lower member including ratcheting fasteners, Velcro straps or the like.

The expansion mechanism 25 enables a person to continuously adjust the interior volume of the suitcase 10 between the compressed configuration and the expanded configuration depending on the person's travel needs. FIG. 3 shows the suitcase 10 in the compressed configuration, in which the adjustable strap 25 is tightened to pull the upper member 30 toward the lower member 35. This, in turn, pulls the upper frame 16 towards the lower frame 18, thereby decreasing the interior volume of the suitcase 10.

FIG. 4 shows the suitcase in the expanded configuration, in which the adjustable strap 56 is loosened, allowing the springs 55*a* and 55*b* to pull the arms 40*a* and 40*b* apart at the lower member 35. This causes the arms 40*a* and 40*b* to push the upper member 30 away from the lower member 35. This, in turn, causes the upper frame 16 and the lower frame 18 to move apart, thereby increasing the interior volume of the suitcase 10. The interior volume may be continuously adjusted to any intermediate volume between the compressed configuration and the expanded configuration by adjusting the length of the strap loop.

The expansion system of the invention provides semi-rigid support compared to prior art systems that use only an expandable section made of fabric. This is because, after the expansion mechanism 25 has been adjusted to a desired volume, the strap 56 resists further expansion of the expansion mechanism 25 and the urging force of the springs 55*a* and 55*b* resists further compression of the expansion mechanism 25.

Another advantage is that the expansion mechanism 25 does not easily break from external forces exerted on the suitcase 10, such as shock. This is because the expansion mechanism 25 resiliently responses to strong external downward exerted on the suitcase 10 forces by compressing instead of breaking.

While an embodiment of the present invention has been shown and described, various modifications may be made without departing from the scope of the present invention, and all such modifications and equivalents are intended to be covered. For example, the structure of the expansion mechanism may be inverted so that the lower member is located above the upper member. Further, the expansion system of the present invention may use any number of expansion mechanisms. For example, the expansion system may use four expansion mechanisms, one on each of the four interior sides of the suitcase. Further, the expansion mechanisms may each have more than two arms and may be attached on the exterior of the suitcase instead of the interior. Further, the luggage of the invention may comprise only one frame, in which each upper member is connected to the border of, e.g., a piece of fabric, a panel, ect., instead of an upper frame or lower frame. Further, although the frames in the preferred embodiment are rigid, one or both of the frames may be made of a soft or semi-rigid material.

What is claimed is:

1. An expandable luggage, comprising:

a first frame;

a second frame, an expandable section attached between the first frame and the second frame;

at least two expansion mechanisms, each expansion mechanism comprising:

a first member attached to the first frame;

a second member attached to the second frame; and two arms, wherein each arm is pivotally connected to the first member and is pivotally and slideably connected to the second member, and further comprising urging means for urging the two arms to opposite ends of the second member.

2. The expandable luggage of claim 1 wherein the expandable section comprises fabric or other pliable material.

3. The expandable luggage of claim 1 wherein the second member has two slots and each arm comprises a pin slideably received in one of the slots.

4. The expandable luggage of claim 1 wherein urging means comprises two springs, wherein each spring is connected at one end to one of the arms and at the other end to the second member.

5. The expandable luggage of claim 1 further comprising an adjustable fastener for adjustably fastening the first member to the second member.

6. The expandable luggage of claim 5 wherein the adjustable fastener comprises an adjustable strap.

7. The expandable luggage of claim 1 wherein urging means comprises two springs, wherein each spring is connected at one end to one of the arms and at the other end to the second member.

8. The expandable luggage of claim 1 further comprising an adjustable fastener for adjustably fastening the first member to the second member.

9. The expandable luggage of claim 8 wherein the adjustable fastener comprises an adjustable strap.

10. An expandable luggage, comprising:

a first frame a second frame, an expandable section attached between the first frame and the second frame;

at least two expansion mechanisms, each expansion mechanism comprising:

a first member attached to the first frame;

a second member attached to the second frame; and two arms, wherein each arm is pivotally connected to the first member and is pivotally and slideably connected to the second member, and wherein the second member has two slots and each arm comprises a pin slideably received in one of the slots and the expansion mechanism further comprises urging means for urging the arms to opposite ends of the second member.

11. An expandable luggage, comprising:

a front panel;

a back panel;

a first frame attached to the front panel;

a second frame attached to the back panel;

an expandable section attached between the first frame and the second frame;

at least two expansion mechanisms, each expansion mechanism comprising:

a first member attached to the first frame a second member attached to the second frame; and two arms, wherein each arm is pivotally connected to the first frame and is pivotally and slideably connected to the second member, and further comprising urging means for urging the two arms to opposite ends of the second member.

12. The expandable luggage of claim 11 further comprising a telescoping handle attached to the second frame.

13. The expandable luggage of claim 12 further comprising at least two wheels rotatably connected to the second frame.

14. The expandable luggage of claim 11 wherein the front panel has a pocket.

15. The expandable luggage of claim 11 wherein the front panel has a front compartment and a zipper opening for accessing the front compartment.

16. The expandable luggage of claim 11 wherein the expansion section comprises fabric or other pliable material.

17. The expandable luggage of claim 11 wherein the front panel has a zipper opening for accessing the interior compartment of the luggage.

18. The expandable luggage of claim 11 wherein the second member has two slots and each arm comprises a pin slideably received in one of the slots.

19. The expandable luggage of claim 11 wherein each of the first and second frames comprise four sides.

* * * * *